US005560049A

United States Patent [19]

Robinson et al.

[11] Patent Number: 5,560,049

[45] Date of Patent: Oct. 1, 1996

[54] TOILET SEAT SAFETY DEVICE

[76] Inventors: Glorious Robinson, Rte. 3-Box 389; Ella M. Damron, Rte. 3-Box 288, both of Adamsville, Tenn. 38310

[21] Appl. No.: 579,227

[22] Filed: Dec. 28, 1995

[51] Int. Cl.[6] ..... A47K 13/24

[52] U.S. Cl. ..... 4/253; 4/661; 4/901

[58] Field of Search ..... 4/253, DIG. 5, 4/DIG. 18, 901, 661; D23/309

[56] References Cited

U.S. PATENT DOCUMENTS

| | | | |
|---|---|---|---|
| D. 289,793 | 5/1987 | Blake . | |
| D. 336,330 | 6/1993 | Harshman et al. . | |
| D. 351,021 | 9/1994 | Martin . | |
| 735,927 | 8/1903 | Woodruff . | |
| 1,763,277 | 6/1930 | Tilden . | |
| 1,793,815 | 2/1931 | McCann . | |
| 2,404,124 | 7/1946 | Des Roches . | |
| 2,558,578 | 6/1951 | Palmieri . | |
| 2,940,086 | 6/1960 | Wondrack | 4/DIG. 5 |
| 3,048,854 | 8/1962 | Miller . | |
| 3,085,611 | 4/1963 | Dolnick . | |
| 3,477,070 | 11/1969 | Kimber . | |
| 4,145,771 | 3/1979 | Khazin . | |
| 4,407,024 | 10/1983 | Schneider . | |
| 4,930,166 | 6/1990 | Salloum . | |
| 5,052,061 | 10/1991 | Nichols | 4/661 |
| 5,067,185 | 11/1991 | Kohler | 4/DIG. 18 |

*Primary Examiner*—Henry J. Recla
*Assistant Examiner*—Charles R. Eloshway
*Attorney, Agent, or Firm*—Hovey, Williams, Timmons & Collins

[57] ABSTRACT

A toilet seat safety device for preventing the lid of a toilet from being lifted. The toilet seat safety includes a cover panel for covering a portion of the toilet lid, a base panel for wrapping around and covering the front portion of the base of the toilet bowl, and a pair of elongated flaps extending transversely from the base panel for wrapping around the rear portion of the toilet bowl and fastening together for securely fastening the toilet seat safety device to the toilet. The toilet seat safety device is formed from cloth material and is therefore washable and easy to attach and remove.

7 Claims, 1 Drawing Sheet

10
12
14
16
18
20
22
24
26
28
30
32
34

TOILET SEAT SAFETY DEVICE

BACKGROUND OF THE INVENTION

1. Field of the Invention

The present invention relates to toilet seat safety devices for preventing the lid of a toilet from being lifted. More particularly, the invention relates to a toilet seat safety device formed from cloth material that covers a substantial portion of a toilet seat lid and securely wraps around and fastens to the rear of the toilet for preventing the toilet seat lid from being lifted while being easy to attach and remove and washable.

2. Description of the Prior Art

Unsupervised children sometimes lift the lids on toilet seats and play in the water contained in the toilet bowl. This can be dangerous since the child may fall in the toilet bowl, and is unsanitary even when the child is not harmed. Additionally, children sometimes drop objects such as toys into the toilet bowl, thus losing the objects and clogging the toilet and sewer lines.

Toilet seat restraining devices for preventing children from lifting the lid of a toilet seat are known in the art. For example, U.S. Pat. No. 2,558,578 discloses a restraining device that includes a plurality of leather straps that buckle around the toilet seat and toilet bowl for preventing the toilet seat lid from being lifted. U.S. Pat. Nos. 2,404,124 and Des. 351,021 disclose similar type toilet seat restraining devices.

Although prior art toilet seat restraining devices effectively prevent the lifting of toilet set lids, they suffer from several limitations that limit their utility. For example, prior art toilet seat restraining devices are difficult to attach and remove because they are typically formed from a plurality of straps that must be wrapped around the toilet and then buckled or snapped together. Additionally, once the straps are removed from the toilet, they often become tangled together, making them difficult to reattach to a toilet.

Another limitation of prior art toilet seat restraining devices is that they are unsightly because the straps and buckles give the appearance that the toilet is chained or roped shut.

A further limitation of prior art toilet seat restraining devices is that they are difficult to wash because they are formed of leather and metal materials. As can be appreciated, this is problematic because toilet seat restraining devices must be frequently cleaned because of the unsanitary nature of their use.

OBJECTS AND SUMMARY OF THE INVENTION

In view of the limitations of prior art toilet seat restraining devices set forth above, it is an object of the present invention to provide an improved toilet seat safety device.

It is a more particular object of the present invention to provide a toilet seat safety device that effectively prevents a toilet seat lid from being lifted while also be easy to attach and remove from the toilet.

It is another object of the present invention to provide a toilet seat safety device that is not unsightly when attached to a toilet.

It is another object of the present invention to provide a toilet seat safety device that can be frequently and easily washed and/or cleaned in a conventional washer and dryer.

In view of these objects and other objects that become evident from the description of the preferred embodiments of the invention herein, an improved toilet seat safety device is disclosed. The toilet seat safety device attaches to any conventionally-sized toilet for preventing the lid of the toilet from being lifted and broadly includes a cover panel for covering a portion of the toilet lid, a base panel for wrapping around and covering the front portion of the base of the toilet bowl, and a pair of elongated flaps extending transversely from the base panel for wrapping around the rear portion of the toilet bowl and fastening together for securely fastening the toilet seat safety device to the toilet.

In preferred forms, the cover panel, base panel, and flaps are formed from cloth material and are sewn together. The flaps are fastened together with hook and loop type fasteners that are sewn to the ends of the flaps.

By constructing a toilet seat safety device as described herein, numerous advantages are realized. For example, by forming the toilet seat safety device with cloth cover and base panels that cover and wrap around the toilet seat lid and toilet bowl rather than with a plurality of straps, the toilet seat safety device is significantly easier to attach and remove than prior art safety devices.

Additionally, by providing the toilet seat safety device of the present invention with hook and loop type fasteners rather than buckles and snaps, the toilet seat safety device can be more easily fastened to and easily and quickly removed from a toilet.

Moreover, by forming the toilet seat safety device of the present invention of cloth material rather than leather and metal, the toilet seat safety device is more cosmetically appealing and can be more easily washed and cleaned in a conventional washer and dryer.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figures 1, 2, 3, 4:
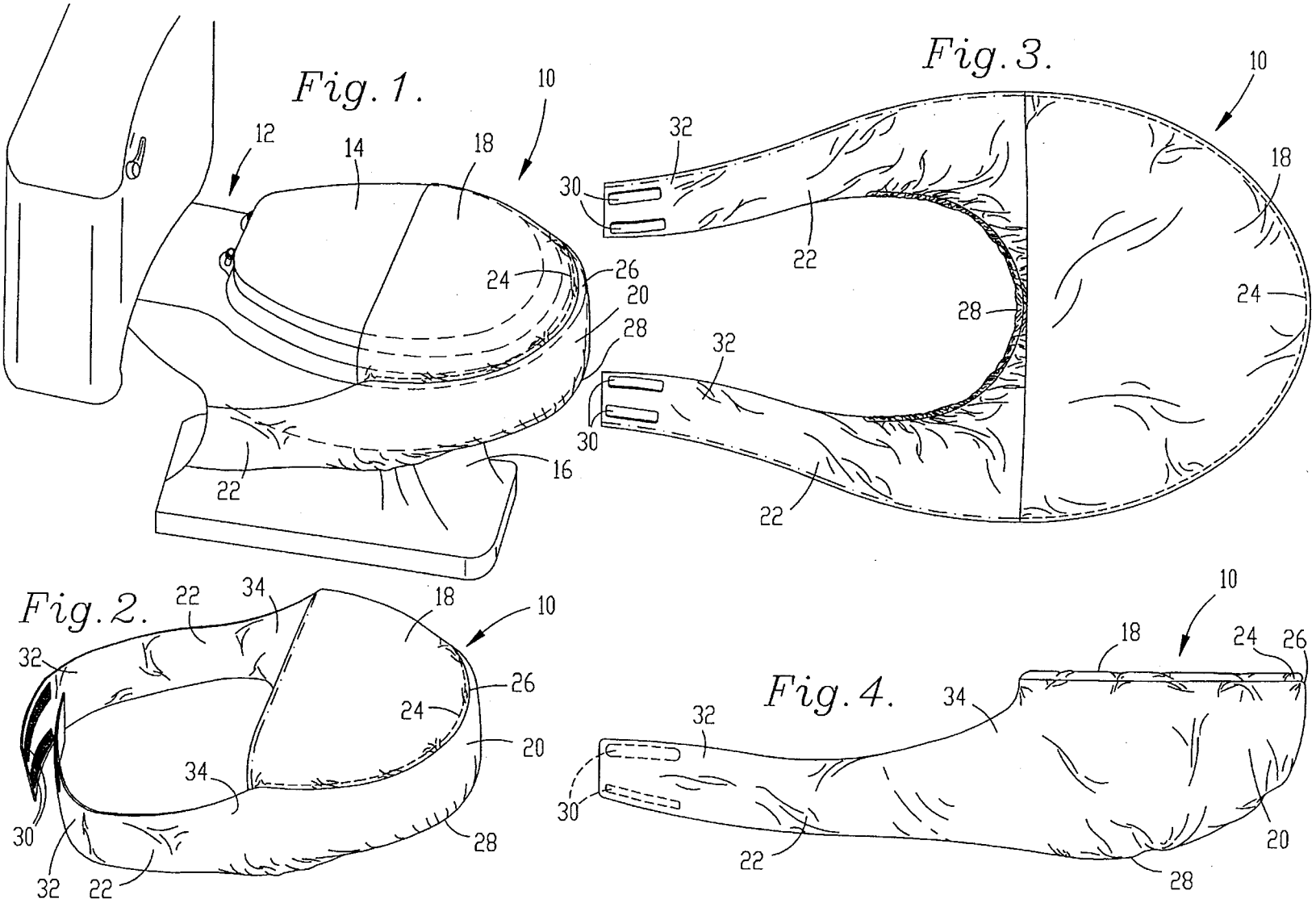
FIG. 1 is a perspective view of a toilet seat safety device constructed in accordance with the preferred embodiment of the present invention shown attached to a toilet for preventing the lid of the toilet from being lifted.
FIG. 2 is a perspective view of the toilet seat safety device shown removed from the toilet.
FIG. 3 is a top view of the toilet seat safety device.
FIG. 4 is a side elevational view of the toilet seat safety device.

Turning now to the drawing figures, and particularly FIG. 1, a toilet seat safety device 10 constructed in accordance with the preferred embodiment of the invention is illustrated. The toilet seat safety device 10 is adapted for use with a conventional toilet 12 having a toilet seat lid 14 and a toilet bowl base 16. When attached to the toilet 12, the toilet seat safety device 10 prevents the toilet seat lid 14 from being lifted.

Referring to FIG. 2, the preferred toilet seat safety device 10 broadly includes a cover panel 18 for covering a portion of the toilet seat lid 14, a base panel 20 for wrapping around and covering the front portion of the toilet bowl base 16, and a pair of elongated flaps 22 extending transversely from the base panel 20 for wrapping around the rear portion of the toilet bowl base 16 and for fastening together for securely fastening the toilet seat safety device 10 to the toilet 12.

In more detail, the cover panel 18 is preferably semi-circular in shape and presents an arcuate edge 24 that conforms to the rounded front edge of the toilet seat lid 14. The cover panel 18 is preferably sized to cover approximately the front half of a conventionally-sized toilet seat lid 14 when the toilet seat lid 14 is closed. Since the cover panel 18 covers a substantial portion of the top of the toilet seat lid 14, it cannot be slipped off the toilet seat lid 14 without first unfastening the flaps 22 from the rear of the toilet bowl base 16. The cover panel 18 is preferably formed of cloth material such as cotton, polyester, or terry cloth.

The base panel 20 is preferably semi-cylindrical in shape and depends transversely from the arcuate edge 24 of the cover panel 18. As best illustrated in FIG. 2, the base panel 20 includes a top edge 26 that is sewn or otherwise attached to the arcuate edge 24 of the cover panel 18 and a lower edge 28 that wraps around the front portion of the toilet bowl base 16. As illustrated in FIG. 3, elastic is preferably sewn into the lower edge 28 of the base panel 20 so that the base panel 20 conforms to the shape of the toilet bowl base 16.

As illustrated in FIG. 1, the base panel 20 is sized to wrap around and cover the front half of a conventionally-sized toilet bowl base 16. The base panel 20 is preferably formed of the same cloth material as the cover panel 18 and may be integrally formed from the same piece of material as the cover panel 18.

The elongated flaps 22 are each attached to opposite sides of the base panel 20 and are preferably integrally formed from the same piece of cloth as the base panel 20. As illustrated, each flap 22 is of a length sufficient to wrap around the rear portion of a conventionally-sized toilet bowl base 16.

As best illustrated in FIG. 4, the proximal end 34 of each flap 22 is of a width approximately equal to the width of the base panel 20. The flaps 22 taper inwardly towards their distal ends 32 for more easily wrapping around the rear of the toilet bowl base 16.

As illustrated in FIG. 2, a plurality of fasteners 30 are preferably sewn or otherwise attached to the distal ends 32 of the flaps 22 for allowing the flaps 22 to be releasably fastened to one another around the rear of the toilet bowl base 16. The fasteners 30 are preferably hook and loop type fasteners such as the type manufactured under the tradename VELCRO.

In use, the toilet seat safety device 10 can be easily attached to a toilet 12 for preventing the toilet seat lid 14 from being lifted. The cover panel 18 and the base panel 20 together form a pouch that wraps around and covers the front halves of the toilet seat lid 14 and toilet bowl base 16. Once the cover panel 18 and base panel 20 are attached to the toilet 12, the elongated flaps 22 are wrapped around the rear portion of the toilet bowl base 16 and fastened together with the hook and loop fasteners 30.

The toilet seat safety device 10 is also easy to remove from the toilet 12. The flaps 22 are merely unfastened from one another by pulling apart the hook and lop fasteners 30, thus allowing the toilet seat safety device 10 to be pulled off the toilet 12. Once removed from the toilet 12, the toilet seat safety device 10 can be washed and dried in conventional washers and dryers without losing its shape.

Although the invention has been described with reference to the preferred embodiment illustrated in the attached drawing figures, it is noted that equivalents may be employed and substitutions made herein without departing from the scope of the invention as recited in the claims .

Having thus described the preferred embodiment of the invention, what is claimed as new and desired to be protected by Letters Patent includes the following:

We claim:

1. A toilet seat safety device for fastening to a toilet for preventing a toilet seat lid from being lifted from a toilet bowl base, said safety device comprising:

a flexible cover panel for covering a substantial portion of the toilet seat lid when the toilet seat lid is closed, a single, continuous, flexible base panel attached to said cover panel for wrapping around a portion of the toilet bowl base;

a pair of elongated flaps extending from said base panel for wrapping around a rear portion of the toilet bowl base, each of said flaps presenting a distal end; and fastening means for releasably fastening said distal ends of said flaps to one another around the rear portion of the toilet bowl base.

2. The toilet seat safety device as set forth in claim 1, wherein said cover panel, base panel, and flaps are formed of cloth material.

3. The toilet seat safety device as set forth in claim 1, said fastening means including hook and loop fasteners attached to said distal ends of said flaps.

4. The toilet seat safety device as set forth in claim 1, said cover panel having a surface area for covering approximately one-half of a top surface of the toilet seat lid.

5. The toilet seat safety device as set forth in claim 1, said cover panel being semi-circular in shape.

6. A toilet seat safety device for fastening to a toilet for preventing a toilet seat lid from being lifted from a toilet bowl base, said safety device comprising:

a pouch including a flexible cover panel formed from cloth material and having a surface area sufficient for covering at least one-half of a top surface of the toilet seat lid when the toilet seat lid is closed, and a single, continuous, flexible base panel attached to said cover panel for wrapping around a portion of the toilet bowl base;

a pair of elongated flaps extending from said base panel for wrapping around a rear portion of the toilet bowl base, each of said flaps presenting a distal end; and fastening means for releasably fastening said distal ends of said flaps to one another around the rear portion of the toilet bowl base, said fastening means including a hook fastener attached to a respective one of said distal ends of said flaps and a loop fastener attached to the other of said distal ends of said flaps.

7. The toilet seat safety device as set forth in claim 6, said cover panel, base panel and said flaps each being formed from cloth material and sewn together to form a single-piece safety device.

* * * * *